United States Patent [19]

Friend et al.

[11] 4,020,428

[45] Apr. 26, 1977

[54] STRIPLINE INTERDIGITAL BAND-PASS FILTER

[75] Inventors: Larry O. Friend, Scottsdale; John J. Lockwood, Tempe, both of Ariz.

[73] Assignee: Motorola, Inc., Chicago, Ill.

[22] Filed: Nov. 14, 1975

[21] Appl. No.: 631,803

[52] U.S. Cl. ..... 333/73 S; 333/73 W; 333/84 M

[51] Int. Cl.[2] ..... H01P 1/20; H01P 3/08; H01P 7/00; H01P 1/16

[58] Field of Search ..... 333/73 R, 73 S, 73 W, 333/84 R, 84 M, 97 R, 98 R

[56] References Cited

UNITED STATES PATENTS

| | | | |
|---|---|---|---|
| 3,391,356 | 7/1968 | Bolljahn et al. | 333/73 R |
| 3,496,498 | 2/1970 | Kawahashi et al. | 333/73 W |

OTHER PUBLICATIONS

Matthael –"Interdigital Band–Pass Filters" in IRE Trans. on Microwave Theory and Techniques, vol. MTT–10, Nov. 1962, pp. 479–491.

*Primary Examiner*—Alfred E. Smith
*Assistant Examiner*—Marvin Nussbaum
*Attorney, Agent, or Firm*—Michael D. Bingham

[57] ABSTRACT

There is disclosed a stripline interdigital filter fabricated in a self-supporting structure and including a plurality of parallel-coupled resonators. The parallel-coupled resonators are disposed between first and second ground planes, which first ground plane being removably mounted to the filter housing to facilitate interchanging of the first ground plane with another ground plane so dimensioned that the spacing between the parallel-coupled resonators and the first ground plane is varied a predetermined amount whereby the band-pass characteristics of the filter are varied.

23 Claims, 4 Drawing Figures

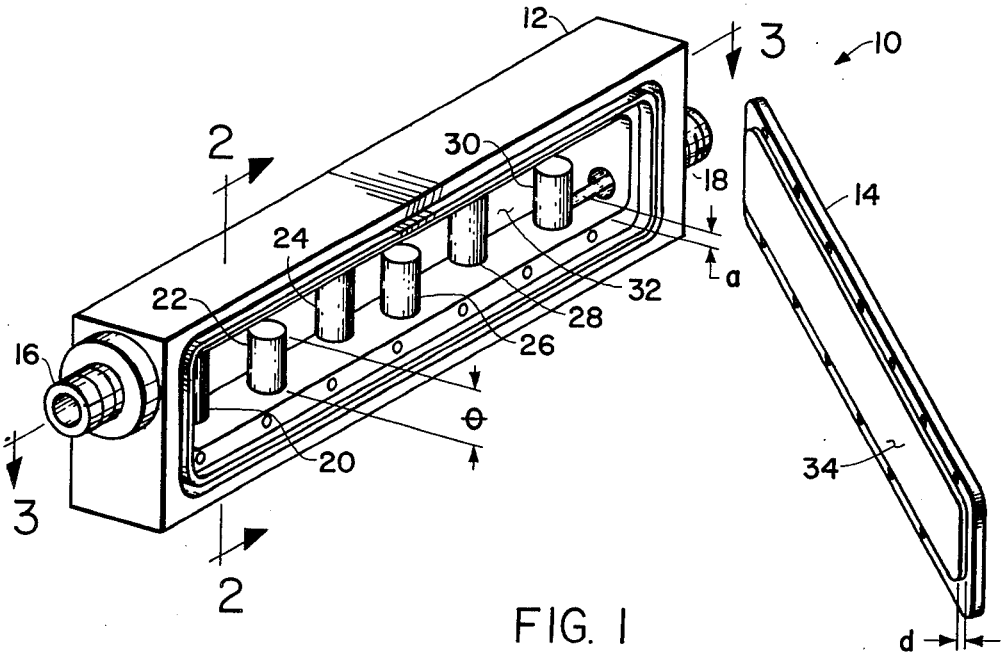
FIG. 1
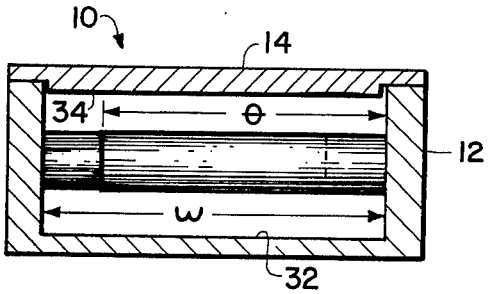
FIG. 2
FIG. 3
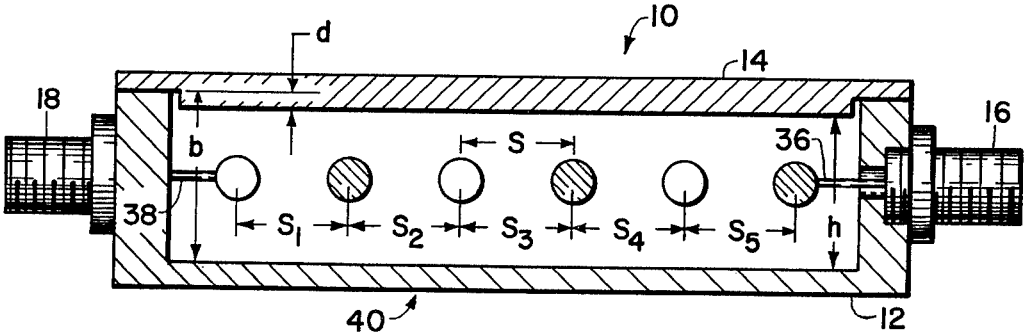

STRIPLINE INTERDIGITAL BAND-PASS FILTER

BACKGROUND OF THE INVENTION

This invention relates to high frequency filters and more particularly to interdigital band-pass, stripline filters having multi-parallel-coupled resonators.

High frequency interdigital band-pass filters have been used for many years by electrical circuit designers, especially by those designers of electrical circuits which are to be operated at frequencies in the microwave range. Interdigital band-pass filters have many attractive features: they are very compact; they can be fabricated of self-supporting structures which eliminate the need for dielectric supporting materials eliminating losses associated therewith; and these filters exhibit good band-pass characteristics having steep skirt responses.

However, one significant disadvantage of self-supported interdigital band-pass filters is the dependence of the bandwidth of the filter to mechanical tolerances such as the physical dimensions of the resonators and the spacing therebetween. In common circumstances, the design of the bandwidth of such filters is not realized in a fabricated filter because of the mechanical tolerances attained during the manufacture of the filter. In most cases, a new filter must be fabricated to correct for such tolerances until the correct bandwidth is obtained in conjunction with other critical filter characteristics such as, insertion loss and voltage standing wave ratios (VSWR). Several iterations of filters may be required until a suitable unit is made. Having to make a new filter, because of tolerances, may be a very expensive step in obtaining a usable filter. Moreover, these iterations can be quite time consuming which in some instances may be more of a disadvantage than the expenses involved in remachining new parts.

Thus, a need exists to enable the designer of such filters to be able to vary the bandwidth of the filter without having to build a new filter part.

SUMMARY OF THE INVENTION

Accordingly, it is an object of the present invention to provide an improved high frequency band-pass filter and method for adjusting the bandwidth thereof.

It is another object of the present invention to provide a high frequency, stripline, band-pass filter having a plurality of parallel-coupled resonators, the filter having a removably mounted ground plane member whereby the bandwidth of the filter is compensated for machine tolerances obtained in the fabrication of the filter.

In accordance with the present invention there is provided a multi-resonator, stripline filter. The filter includes first and second ground plane members spatially related to each other and a plurality of parallel-coupled resonators disposed therebetween. The input and output to the filter is affected by direct coupling to the end resonators comprising the filter. The first ground plane member is removably mounted to the filter structure to facilitate interchanging the same with another ground plane member so dimensioned that the spacing between the parallel-coupled resonators and the first ground plane member is varied whereby the band-pass characteristic of the filter is varied.

BRIEF DESCRIPTION OF THE DRAWINGS

FIG. 1 is a perspective view of the stripline filter in accordance with the present invention;

FIG. 2 is a cross-sectional view of the stripline filter of the present invention taken substantially in the direction of the arrows 2—2 of FIG. 1;

FIG. 3 is a cross-sectional view of the stripline filter of the present invention taken substantially in the direction of the arrows 3—3 of FIG. 1.

DETAILED DESCRIPTION OF THE PREFERRED EMBODIMENT

Figure 4:
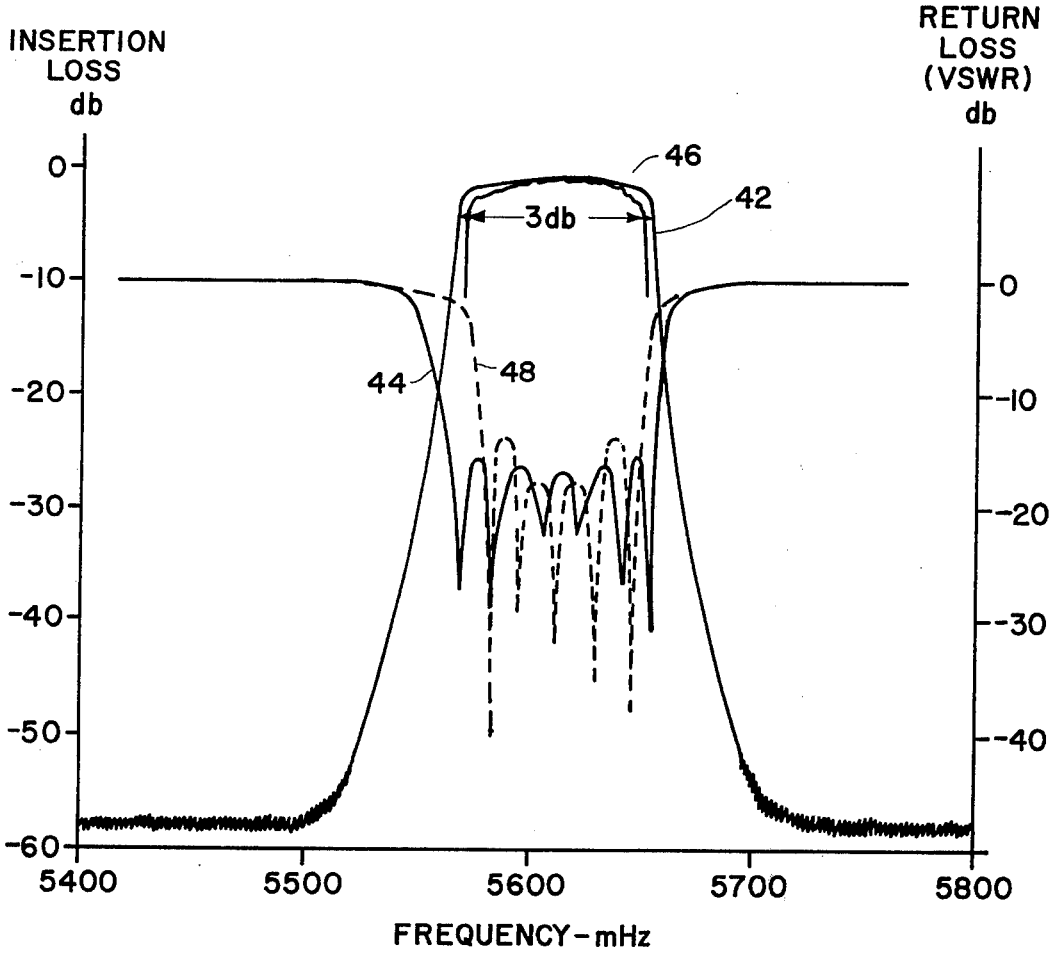
FIG. 4 is a graph illustrating data taken for the stripline filter of the present invention.

Referring to FIGS. 1 and 2 there is illustrated stripline filter 10 of the present invention. Filter 10 comprises housing 12, cover 14 and connectors 16 and 18 respectively. The structure of filter 10, as shown, consists of a plurality of transverse electromagnetic (TEM)-mode stripline resonators 20 through 30. The resonators are positioned between surface 32 of housing 12 and surface 34 of cover 14, which surfaces are the ground planes of stripline filter 10. It is understood that stripline filter 10 is fabricated in self-supporting structure so that dielectric materials need not be used.

For convenience in manufacturing, housing 12 may be machined from a single piece with resonators 20 through 30 being machined separately. It should be recognized that housing 12 and resonators 20 through 30 could be fabricated in a single process from a master mold. It is noted that the illustration of FIG. 1, for purposes of clarity, does not include minor structural details such as nuts, bolts, welds, etc., and is not shown in actual proportions. Housing 12 and cover 14 may be formed of any good conducting metal which may be suitably plated to achieve maximum electrical conductivity. Also, filter 10 may be formed of a low temperature coefficient metal, such as Invar, which would stabilize the filter's electrical characteristics with temperature changes.

Each resonator element is of a predetermined length, $\theta$ which may be a quarter-wave length long at the mid-band frequency at which filter 10 is designed to operate. Moreover, each resonator is short-circuited at one end and open-circuited at the other end, with adjacent resonators, for example, resonators 24 and 26 having opposite ends open-circuited. Thus, filter 10 is known in the art as being an interdigital filter. It is to be understood that filter 10 could also be a combline filter. Coupling is achieved by way of the electromagnetic fields fringing between adjacent parallel-coupled resonator elements. Each resonator element serves as an individual resonator. The design equations for determining; the ground plane spacing $b$, respective resonator spacings S, and resonator diameter, are well known in the art and such design equations are readily available to the practitioner as, for example, may be found in the filter design handbook, "Microwave Filters, Impedance Matching Networks and Coupling Structures":, Mathi, Young & Jones, McGraw-Hill, 1964.

As previously mentioned, each element (20–30) of filter 10 serves as a resonator. Filter 10, being generally a symmetrical structure, exhibits the same characteristics, i.e., insertion loss and voltage standing wave ratios (VSWR) regardless of which end is used as the input or output for the filter. Connectors 16 and 18, which may be any suitable coaxial connector available to one in the art, are illustrated as being directly coupled to end resonators 20 and 30 respectively by conductors 36 and 38. The distance, a, at which the end resonators are tapped to receive conductors 36 and 38 is determined to provide optimum impedance matching as is understood. Although the parallel-coupled resonators of filter 10 are illustrated as being cylindrical rods, resonators 20–30 may also be rectangular in structure.

Interdigital band-pass filters of the above described type have several attractive features, the most significant being:

1. They are very compact;
2. The second pass-band is centered at three times the center frequency of the first pass band, with no possibility of spurious responses therebetween;
3. The rates of the cut-off and the stop bands are enhanced by multiple-order poles of attenuation at DC and even multiples of the operating center frequency; and
4. These types of filters can be fabricated, as illustrated, in structural forms which are self-supporting thereby eliminating the need for dielectric materials and the dielectric losses associated therewith.

However, the above filter does have a serious drawback which until presently has not been satisfactorily overcome by those skilled in the art. Commonly, after the filter dimensions have been determined, during fabrication of the filter to these dimensions can not be maintained due to mechanical tolerances of the machining process. Thus, even though the paper design of the filter predicts theoretical performance data, the mechanical filter usually exhibits quite different characteristics. For example, the bandpass characteristics may be skewed and furthermore not have the desired center frequency. Moreover, the return loss ripple may be significantly distorted. In the past, those skilled in the art have had very few options for correcting the filter's characteristics. The most common practice is to re-machine the filter until tolerances are obtained which will provide a usable working filter. This process can be quite expensive and time consuming. Another method to correct machine tolerances is to drill and tap holes into either one or both of the ground plane walls, 14 or 40, (FIG. 3) between resonators and to insert tuning screws therebetween. In some cases a combination of the above two remedies may be utilized, i.e., the filter is re-machined with tuning screws added. Even these latter remedies are not satisfactory solutions. Thus, added expenses due to machining of new parts and the time consumed therefor as well as the time required for tuning the filter with additional tuning screws have been a disadvantageous property of the stripline interdigital filter described above.

The most commonly utilized method for changing the above filter's bandwidth is to change the relative spacing, S, between resonators. This of course has a drawback in that new parts must be machined also.

However, it has been discovered that unsymmetrically varying the ground plane spacing, *b*, i.e., is to make the spacing between the resonators to one ground plane different from the spacing between the resonators to the other ground plane, that the bandwidth of the aforedescribed filter may be varied without effecting the other characteristics of the filter. As illustrated, ground plane cover 14 is removably mounted to filter 10 with the inward formed surface 34 having a dimension, *d*. As the dimension, *d*, is varied, for example, the dimension is increased, the bandwidth of the filter is narrowed without affecting the center frequency of the filter or the return loss ripple. Adjusting the ground plane cover dimension, *d*, effectively adjusts the coupling between resonators, thus, adjusting the filter bandwidth. This has the advantage of allowing one to change the filter bandwidth without the expense of matching a new filter housing. Furthermore, the dimension *d* can be held to very critical tolerances to compensate for the tolerances of the machine filter housing.

The most common way of adjusting filter bandwidth in the prior art is to change the resonators spacings with respect to each other and the other filter dimensions. The results of varying the bandwidth of the filter by unsymmetrically varying the ground plane spacing of the filter, without affecting the VSWR or ripple characteristics of the filter, was quite "unexpected". One skilled in the art would believe that by unsymmetrically varying the ground plane spacing would affect the VSWR characteristics and/or cause spurious responses to appear in out-of-band frequencies near the bandpass of the filter. However, it was found that neither of the above characteristics of the filter was affected.

By way of example only, a filter has been built having a removably mounted ground plane cover and tested with various dimensions, *d*, as illustrated hereinbelow.

Referring to FIG. 4, there is shown a graph illustrating the insertion loss and return loss of a stripline filter built to the present specification. Curves 42 and 44 show the insertion loss and return loss, in decibels, of a filter built with the dimension, *d*, being equal to 0.010 inches. The 3db bandwidth of this filter is equal to approximately 92 MHz with a central frequency of 5,611.5 MHz. Curves 46 and 48 illustrate the insertion loss and return loss of the same filter with exception that the dimension, *d*, was equal to 0.025 inches. The 3db bandwidth of this filter was equal to approximately 79 MHz with a center frequency of 5,611.4 MHz. Both of the above filters had the following dimensions:

| No. of resonators | 5 | |
|---|---|---|
| resonator dia | 0.176 inches | typically |
| W | 0.500 inches | " |
| 0 | 0.401 inches | " |
| $S_1$ & $S_5$ | 0.634 inches | " |
| $S_2$ & $S_4$ | 0.684 inches | " |
| $S_3$ | 0.691 inches | " |
| a | 0.025 inches | " |

What has been disclosed and described above is an interdigital band-pass stripline filter having a removably mounted ground plane member which may be interchanged with alternate ground plane members for varying the band-pass characteristics of the filter. The interchangeable ground plane member provides for unsymmetrically varying the ground plane spacing of the parallel-coupled resonators disposed therebetween. Thus, the band-pass characteristics of the filter may be compensated for differences therein due to maintaining tolerances obtained during the fabrication of the filter.

What is claimed is:

1. A high frequency, stripline band-pass filter having a housing member, comprising:

a first ground plane member;

a second ground plane member spaced in parallel relationship to said first ground plane member;

a plurality of parallel-coupled resonators disposed between said first and second ground plane members;

input means for coupling input signals to the filter;

output means for coupling the output of the filter to a load; and said first ground plane member being removably mounted to the filter housing member to facilitate interchanging of said first ground plane member with another ground plane member so dimensioned that the spacing between said plurality of parallel-coupled resonators and said first ground plane member is greater or less by a predetermined amount than the spacing between said plurality of parallel-coupled resonators and said second ground plane member whereby said resonators are unsymmetrically disposed between said first and second ground plane member so that the bandwidth of the filter is respectively increased or decreased.

2. The filter of claim 1 wherein said plurality of parallel-coupled resonators are cylindrical rod members.

3. The filter of claim 2 wherein said resonators have an electrical length of 90° at the mid-band frequency of the filter.

4. The filter of claim 1 wherein said plurality of parallel-coupled resonators are rectangular members.

5. The filter of claim 4 wherein the electrical length of said resonators is 90° at the mid-band frequency of the filter.

6. The filter of claim 1 wherein said plurality of parallel-coupled resonators are interdigitalized.

7. The filter of claim 6 wherein said interdigitalized resonators are cylindrical rod members.

8. The filter of claim 7 wherein the electrical length of said cylindrical rod members is 90° at the mid-band frequency of the filter.

9. The filter of claim 6 wherein said interdigitalized resonators are rectangular members.

10. The filter of claim 9 wherein the electrical length of said resonators is 90° at the mid-band frequency of the filter.

11. The filter of claim 1 wherein said plurality of parallel-coupled resonators is interdigitalized with the opposite ends of adjacent interdigital resonators being connected to a short-circuit.

12. The filter of claim 11 wherein said interdigital resonators are cylindrical rod members.

13. The filter of claim 12 wherein the electrical length of said resonators is 90° at the mid-band frequency of the filter.

14. The filter of claim 11 wherein said interdigital resonators are rectangular rod members.

15. The filter of claim 14 wherein the electrical length of said resonators is 90° at the mid-band frequency of the filter.

16. The filter of claim 1 wherein said input means includes connector means adapted to be directly coupled to the first one of said plurality of parallel-resonators.

17. The filter of claim 1 wherein said output means includes connector means adapted to be directly coupled to a last one of said plurality of parallel-coupled resonators.

18. Filter of claim 1 wherein said input means includes first connector means adapted to be connected to first one of said plurality of parallel-coupled resonators; and said output means includes second connector means adapted to be connected to a last one of said plurality of parallel-coupled resonators.

19. The filter of claim 18 wherein said plurality of parallel-coupled resonators are interdigitalized and have a cylindrical structure, the opposite ends of adjacent resonators being connected to a short-circuit.

20. An interdigital stripline, band-pass filter having a housing member, comprising in combination:

a first ground plane member;

a second ground plane member spaced in parallel relationship to said first ground plane member;

a plurality of interdigitalized parallel-coupled resonators disposed between said first and second ground plane members, each resonator being attached at one end thereof to the housing member;

input means for coupling input signals to the filter;

output means for coupling the output of the filter to a load; and said first ground plane member being removably mounted to the filter housing member to facilitate interchanging of said first ground plane member with another ground plane member so dimensioned that the spacing between said plurality of parallel-coupled resonators and said first ground plane member is greater or less by a predetermined amount than the spacing between said plurality of parallel-coupled resonators and said second ground plane member whereby said resonators are unsymmetrically disposed between said first and second ground planes so that the bandwidth of the filter is respectively increased or decreased.

21. The filter of claim 20 wherein:

said input means includes first connector means adapted to be connected to a first one of said plurality of parallel-coupled resonators; and said output means includes second connector means adapted to be connected to a last one of said plurality of parallel-coupled resonators.

22. The filter of claim 21 wherein each of said parallel-resonators are cylindrical rod members having an electrical length of 90° at the mid-band frequency of the filter.

23. For an interdigital stripline, bandpass filter having a housing member, first and second parallel spaced ground plane members, a plurality of resonators disposed between the ground plane members, a method for varying the bandwidth of the filter including the step of varying the ground plane spacing between said first ground plane member and all of said resonators whereby all of said resonators are then unsymmetrically disposed between the ground plane members.

* * * * *